US005401338A

United States Patent [19]

Lin

[11] Patent Number: 5,401,338

[45] Date of Patent: Mar. 28, 1995

[54] PROCESS FOR MAKING METAL-MATRIX COMPOSITES REINFORCED BY ULTRAFINE REINFORCING MATERIALS PRODUCTS THEREOF

[76] Inventor: Ching-Bin Lin, c/o Hung Hsing Patent Service Center, P.O. Box 55-1670, Taipei (10477), Taiwan, Prov. of China

[21] Appl. No.: 103,049

[22] Filed: Jul. 28, 1993

[51] Int. Cl.[6] ..... C21D 10/00

[52] U.S. Cl. ..... 148/538; 75/683; 75/684; 148/549; 420/590

[58] Field of Search ..... 148/538, 549; 222/195; 75/586, 683, 684; 420/590; 164/473, 474, 475, 55.1, 61, 66.1, 68.1, 97

[56] References Cited

U.S. PATENT DOCUMENTS 4,007,062 2/1977 Sifferlen ..... 75/683

*Primary Examiner*—Richard O. Dean
*Assistant Examiner*—Robert R. Koehler

[57] ABSTRACT

A process for making metal-matrix composite includes adding ultrafine reinforcing material having a particle size as fine as 0.05 μm into the metal alloy matrix in a refining furnace to be homogeneously dispersed in the matrix for producing metal-matrix composite by a refining process, which is degassed to remove gases to eliminate porosity in the composite, thereby producing metal-matrix composite having improved mechanical properties.

6 Claims, 4 Drawing Sheets

PROCESS FOR MAKING METAL-MATRIX COMPOSITES REINFORCED BY ULTRAFINE REINFORCING MATERIALS PRODUCTS THEREOF

BACKGROUND OF THE INVENTION

A conventional metal-matrix composite may be incorporated with reinforcing material therein for strengthening its mechanical property.

According to Orowan's theory, when a dislocation movement in the metal matrix encounters a second-phase or dispersion reinforcing material, the dislocation movement will be hindered so as to prevent material deformation and to strengthen the properties of the composite.

Reviewing a particle dispersion theory as disclosed by Orowan, a strength increment $(\tau-\tau_0)$ of a metal-matrix composite may be expressed in the following formula:

$$\tau-\tau_0=Gb/\lambda$$

wherein, $\tau$ and $\tau_0$ are each a yeild strength of the metal-matrix composite and its original metal matrix, G is a shear modulus of the metal matrix, b is a Burgers vector, and $\lambda$ is a distance between two neighbouring particles of the second-phase or dispersion reinforcing material.

Assuming the particle of the reinforcing material is spherically shaped, the distance $\lambda$ between particles of the reinforcing material will be:

$$\lambda=4(1-f)r/3f$$

Where f is a volume fraction of the reinforcing material particle in the matrix, and r is a radius of the reinforcing material particle. material particle.

Then, the strength increment of the metal-matrix composite is formulated to have to do with the radius of the particle of the dispersion reinforcing material as follows:

$$\tau-\tau_0=3fGb/4(1-f)r$$

For the above-mentioned formula, if the volume fraction f of the reinforcing material particle in the matrix is fixed, the strength increment $(\tau-\tau_0)$ of the metal-matrix composite will be increased depending upon a decrease of particle radius r of the dispersion reinforcing material.

Therefore, it is expected to make the reinforcing material as fine as possible and expected to homogeneously disperse the reinforcing material in the matrix to thereby enhance the mechanical properties of the metal-matrix composites.

However, the fine reinforcing material, once directly fed into the metal matrix, the fine particles due to Van der walls force existing among the particles, will cluster in the metal matrix mixed with the fine particles of the reinforcing material, thereby causing unhomogeneous dispersion of the fine particles in the matrix and deteriorating the property of a finished casting product therefrom.

Meanwhile, a fine reinforcing material of dry particulates is directly incorporated into a molten metal alloy such as an aluminum alloy, the dry fine particulate reinforcing material will easily fly over as effected by a convection hot air streamflow above the molten alloy to cause loss of the fed reinforcing material. Meanwhile, the feed rate for adding the fine reinforcing material into the matrix will be difficultly controlled.

By using a vortex agitator for refining a metal-matrix composite, gases may be directed into the molten metal solution which should be removed by a degassing operation before casting process. Re-melting the metal-matrix composite under high vacuum degree may remove partial gases in the composite. However, the molten metal solution has a high viscosity, thereby being uneasy to extract gases outwardly from the viscous molten solution.

It is therefore expected to invent a process for well incorporating fine particulate reinforcing material into the metal matrix during its refining process, and also providing a reliable degassing operation for efficiently removing gases in the composite product.

SUMMARY OF THE INVENTION

The object of the present invention is to provide a process for making metal-matrix composite by adding ultrafine reinforcing material having a particle size preferably as fine as 0.05 μm or even finer into the metal alloy matrix to be homogeneously dispersed in the matrix in a refining furnace, which is degassed to remove gases from the composite to eliminate porosity in the composite, thereby producing metal-matrix composite having improved mechanical properties.

DETAILED DESCRIPTION

Figure 1:
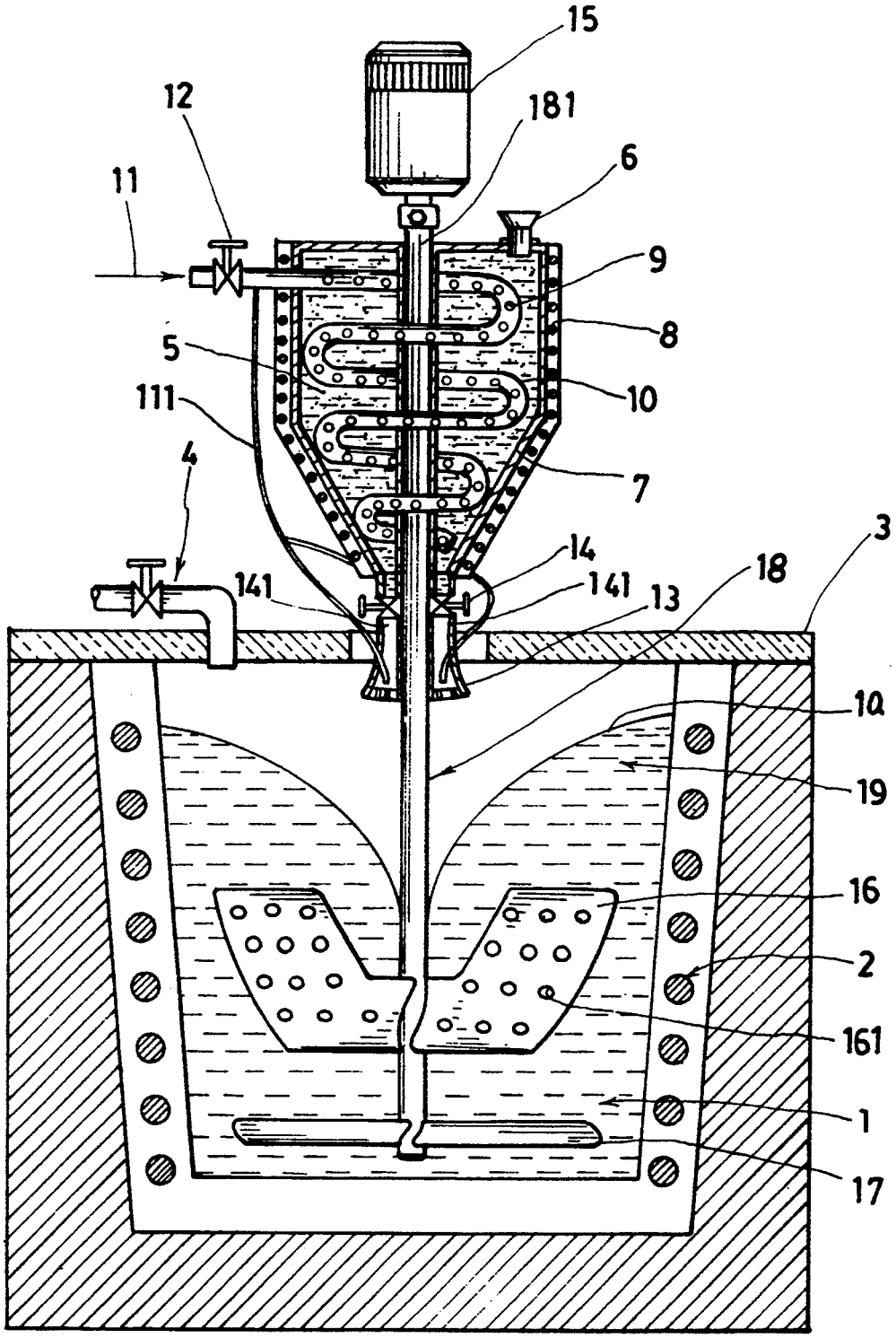
FIG. 1 shows an apparatus for making the metal-matrix composite in accordance with the present invention.

A process for making metal-matrix composites in accordance with the present invention is described hereinafter:

First, in a closed system, the ultrafine reinforcing material is suspended in a distilled water added with proper amount of dispersing agent therein to form a suspension liquid. The suspension liquid is oscillated by ultrasonic waves for about half an hour to disperse the reinforcing material thoroughly. The suspension liquid is then filled in a closed feeding container which is heated to exert heat convection therein and a nitrogen gas streamflow is also directed into the feeding container for maintaining a well dispersion state of the reinforcing material in the suspension liquid.

The ultrafine reinforcing material may be in the forms of particles, whiskers and short fibers, and may be selected from the group of: alumina, silicon nitride, silicon carbide, titanium carbide, zirconium oxide, boron carbide and tantalum carbide.

In a crucible or furnace filled with molten aluminum alloy, the above-mentioned suspension liquid containing the reinforcing material is sprayed or atomized onto the surface of the molten aluminum alloy at high temperature. At this moment, the distilled water in the suspension liquid is rapidly vaporized to help disperse the reinforcing material on the molten aluminum alloy, which is continuously agitated and blanketed by insert gas such as nitrogen or argon gase.

A degassing pipe is inserted into the composite containing the molten aluminum alloy and the reinforcing material to extract bubbles or gases existing in the agitated molten liquid. The degassing pipe may be manually moved within the crucible to increase the opportunities in contact with the gas bubbles in the molten liquid so as to efficiently remove the gas bubbles from the composite. The degassing pipe should not react with the molten liquid in the crucible.

Since an attractive force of Van der Waals force may exist among the ultrafine particles of the reinforcing material to be used in this invention to cause cluster phenomena, the fine reinforcing material is prepared to be a suspension liquid as suspended in the distilled water having dispensing agent added therein. When being fed into the crucible, the suspension liquid is well agitated by heat convection and a nitrogen gas is atomized in the suspension liquid to be kept at a better dispersion condition for preventing a cluster phenomena.

When the suspension liquid is distributed, atomized or sprayed to the surface of molten aluminum alloy, the distilled water in the suspension liquid will be spilled over above the surface of the molten aluminum alloy due to a great temperature difference between the suspension liquid and the hot molten aluminum alloy, thereby enhancing a dispersion of the reinforcing material in the alloy. The reinforcing material sprayed on the surface of the molten aluminum alloy will instantly form a thin-layer film of homogeneously dispersed reinforcing material. The film of the dispersed reinforcing material will then be agitated and forced into the molten aluminum alloy to be homogeneously dispersed in the aluminum alloy matrix by an agitating means. The fine reinforcing material is applied into the molten aluminum matrix when kept at a suspension state for a well controlled feeding rate of the reinforcing material fed into the matrix since the suspension liquid of reinforcing material can be easily and conveniently handled with minimized flying loss of the reinforing material in comparison with a conventional dry fine reinforcing material.

An apparatus for making the composites of the present invention is shown in FIG. 1, which includes:

a heating furnace or crucible (such as heated by electric resistors) 2 filled with aluminum alloy matrix 1 for melting the aluminum alloy matrix 1 and having a ceramic cover 3 covering an upper opening of the furnace 2;

an inert gas supply means 4 having a conduit connected to the furnace 2 for directing inert gas such as nitrogen or argon gas into the furnace 2 for blanketing a molten alloy solution in the furnace 2 for preventing oxidation thereof;

a closed feeding container or charger 7 mounted on an upper position of the furnace 2, having a suspension-liquid valve 6 provided on an upper portion of the feeding container 7 for filling suspension liquid 5 of ultrafine reinforcing material, which is dispersed in distilled water and dispersing agent, in the feeding container 7, a heating medium 8 such as a heating coil surrounding the feeding container 7 for producing heat convection in the container 7 for heating the suspension liquid 5 in the feeding container 7, an inert-gas pipe or a coil tube 10 (which may be made of stainless steel) disposed in the feeding container 7 having a plurality of perforations 9 drilled in the inert-gas pipe 10 for bubbling inert gas such as nitrogen gas supplied from a nitrogen source or bottle 11 through a gas valve 12 formed on an inlet portion of the inert-gas pipe 10, and at least a distributing pipe 141 having a distribution-control valve 14 formed on the distributing pipe 141 and a nozzle 13 secured on a lowest end portion of the distributing pipe 141 for distributing, spraying or atmomizing suspension liquid 5 from the feeding container 7 into the furnace 2 (Note: In order to effectively atomize the suspension liquid into the furnace 2, a compressed inert gas by-pass pipe 111 is branched from pipe 11 and led into nozzle 13 by applying the compressed inert gas to help atomize the suspension liquid into the furnace through the nozzle 13.);

an agitating means 18 provided in the furnace 2 for thoroughly mixing the aluminum alloy matrix 1 with the suspension liquid 5 sprayed or atomized from the feeding container 7; and a degassing means 20 provided in the furnace 2 for removing gases existing in the molten solution 19 by mixing the aluminum alloy matrix 1 with the suspension liquid 5 containing the ultrafine reinforcing material for preventing porosity of a finished casting product of this invention.

The agitating means 18 includes: an agitator shaft 181 (which may be coated with an alumina coating for protecting the shaft) secured to a driving motor 15 (such as a direct-current motor with variable speed adjustment) mounted above the feeding container 7 having the agitator shaft 181 passing through a central portion in the feeding container 7 and protruding downwardly into the furnace 2, and a plurality of impellers such as an upper and a lower impellers 16, 17 respectively radially secured to the agitator shaft 181 submerged in the molten solution 19 in the furnace 2 for thoroughly mixing the alloy matrix 1 with the suspension liquid 5 containing the ultrafine reinforcing material of the present invention.

The upper impeller 16 includes a plurality of upper blades generally vertically oriented with each upper blade generally perpendicular to an inside vertical wall in the furnace 2, having a plurality of blade perforations 161 formed in each upper blade for increasing the shear strength of the upper blades when rotated to increase an efficient dispersion of the ultrafine particles of the reinforcing material in the alloy matrix. The upper blades are able to produce helical cone or vortex 1*a* as shown in FIG. 1 to recirculatively turnover an upper layer of the molten solution 19 (sprayed with the suspension liquid 5) into the lower layer of the molten solution 19 to thoroughly mix the alloy matrix I with the ultrafine reinforcing material in the furnace 2.

The lower impeller 17 includes a plurality of lower blades radially secured to a lower portion of the agitator shaft 181 below the upper blades of the upper impeller 16, the lower blades of the lower impeller being formed as a propeller which may have a projective side view generally horizontal to a bottom surface in the furnace 2, but not limited in this invention. The lower blades may produce convection flow in the furnace for thoroughly mixing the alloy with the reinforcing material especially in the bottom portion of the furnace 2. Other designs of impeller blades may be made in this invention.

Figure 2:
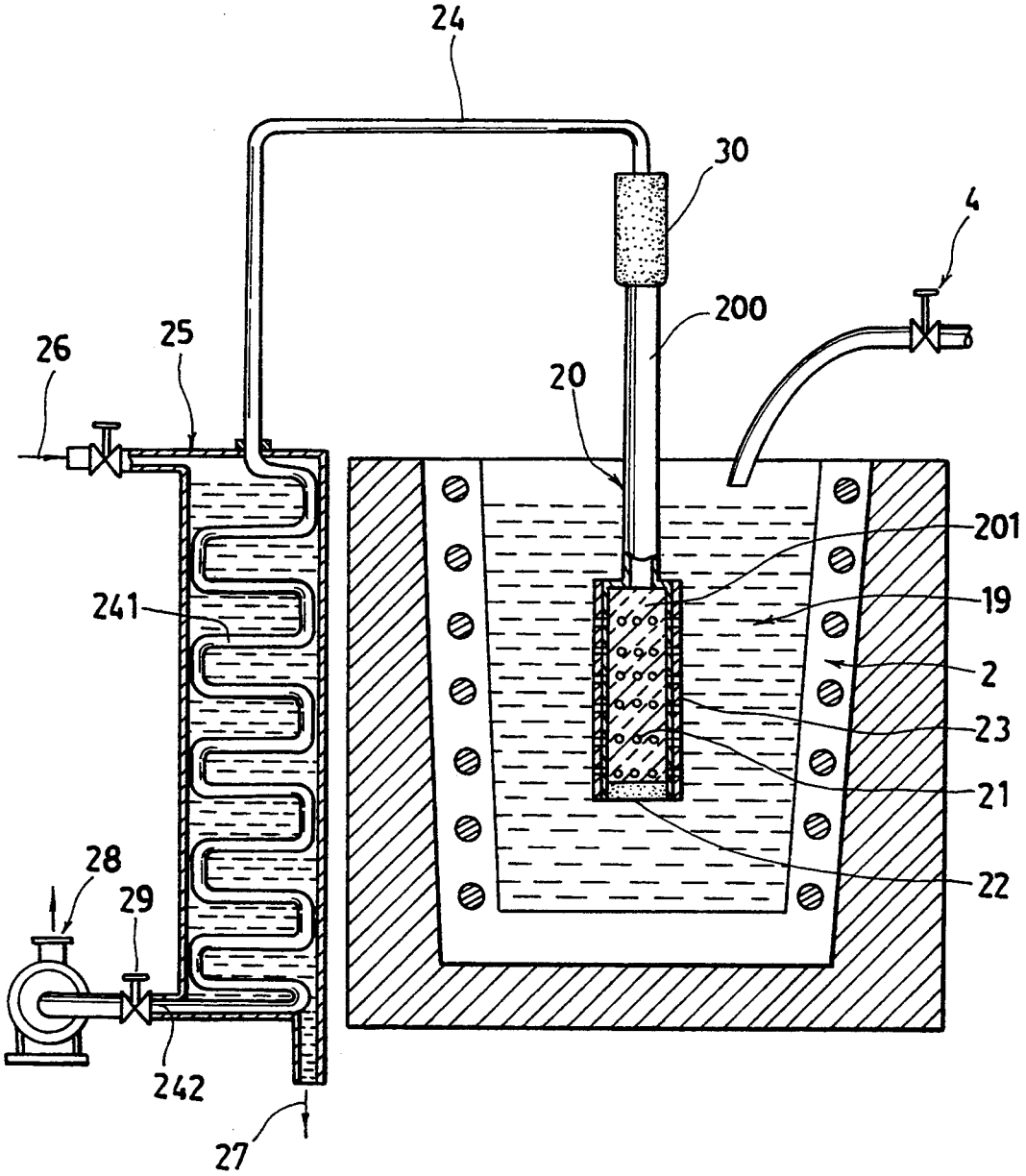
FIG. 2 shows a degassing apparatus in accordance with the present invention.

The degassing means 20 as shown in FIG. 2 includes: a degassing pipe 200 such as made of stainless steel having an enlarged pipe section 201 formed on a suction end of the degassing pipe 200 with a heat-resistant ceramic wool 21 filled in the enlarged pipe section 201 drilled with a plurality of degassing perforations in the enlarged pipe section 201, a refractory clay 22 sealing a bottom opening of the enlarged pipe section 201 and a protective coating 23 such as made of alumina coated on the degassing pipe 200, 201, with the enlarged pipe section 201 submerged in the molten solution 19 in the furnace 2 for removing gases therein. The inert gas is still provided from the inert gas supply means 4 for blanketing use.

The degassing pipe 200 of the degassing means 20 is connected with a flexible hose (such as flexible metal hose) 24 which is connected with a coil exhaust pipe 241 passing through a heat exchanger 25 having cold-water inlet 26 for enterring cold water into the heat exchanger 25 for cooling the exhaust pipe 241 in the exchanger 25 and a warm-water outlet 27 for discharging warm water from the exchanger 25, with an exhaust fan or vacuum pump 28 provided in a tail pipe section 242 connected to the coil exhaust pipe 241 for exhausting the gases as sucked from the suction end of the enlarged pipe section 201 through an exhaust control valve 29 formed on the tail pipe section 242. The control valve 29 will control a system pressure required in the degassing operation.

A ceramic handle 30 may be provided to surround the degassing pipe 200 for safe and easy manipulation of the degassing pipe 200.

Even though the degassing means 2 may be manually operated to insert the suction end portion to every corner in the furnace 2 for a complete gas removal. However, an automatic device such as a robot may be provided for automatically performing such a degassing job, which is not limited in this invention.

By using the equipments as illustrated in FIGS. 1, 2, the present invention can be worked for making metal-matrix composites as reinforced with ultrafine reinforcing materials. A description of the process of the present invention is further described with reference to the following examples:

EXAMPLE 1

An aluminum alloy (5083 Al) is remelted at 700° C. in the furnace 2 as shown in FIG. 1, wherein a flux is added and a protective atmosphere blanketed by nitrogen or argon gas is applied in the furnace in a partially closed system. The feeding container 7 and agitating means 18 as shown in FIG. 1 is mounted in/above the furnace 2. The driving motor 15 is started to rotate the impellers 16, 17 of the agitating means 18 to a rotation speed of 400 rpm.

A suspension liquid (with 20 vol % reinforcing material) is prepared by adding reinforcing material of ceramic particulate alumina of $\gamma$ (gamma) phase, particle size 0.05 $\mu$m, into a distilled water in the presence of 0.05 weight % dispersing agent, which is produced from R. T. Vanderbuilt Co., trade name Darven C, containing major ingredient of ammonium polymethacrylate. The suspension liquid 5 is oscillated by ultrasonic waves for 30 minutes and is poured into the feeding container 7. By adjusting the gas control valve 12 to adjust the flow rate of nitrogen into the container 7 and opening the suspension liquid valve 14, the suspension liquid suspended with the particulate alumina is then quantitatively sprayed through the nozzle 13 onto the molten solution of the aluminum alloy 1 in the furnace 2 under agitation. The agitating rotation speed of the agitating means 18 is then reduced to 80 rpm after finishing the spraying operation of the suspension liquid into the molten alloy for continuing the rotation of 10 minutes. The motor is switched off, and the feeding container 7 with the agitating means 18 are removed.

A composite thus obtained containing 8 Vf (volume fraction)% 0.05 $\mu$m Alumina is maintained at 750° C. for degassing. The degassing pipe 200 is inserted into the furnace to statically immerse all perforations on the degassing pipe into the molten solution 19 for two minutes. Cold water 26 is directed into heat exchanger 25 and the exhaust fan or vacuum pump 28 is started to reach a pressure of $10^{-2}$ torrs for sucking gases from the furnace. The degassing pipe 200, 201 is slowly moved in the molten solution (without stirring) to suck gases in the molten solution for about 30 minutes for degassing operation.

Figure 3:
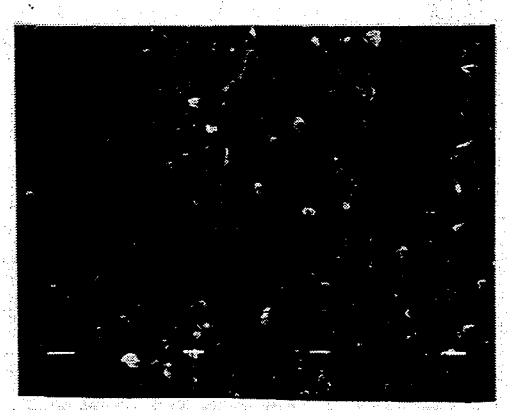
FIG. 3 is a picture showing an aluminum alloy matrix reinforced by alumina particulates in accordance with the present invention.

The degassing pipe 200 is then removed from the furnace 2. The molten aluminum alloy reinforced with alumina is then conducted for casting for obtaining an ingot which is placed in a homogenizing or air furnace at 430° C. for 48 hours for homogenization of the casting ingot. The homogenizing furnace is then cooled to room temperature. A microscopic picture of the composite is shown in FIG. 3 denoting an effective and homogeneous incorporation of the reinforcing alumina in the aluminum alloy.

EXAMPLE 2

Figure 4:
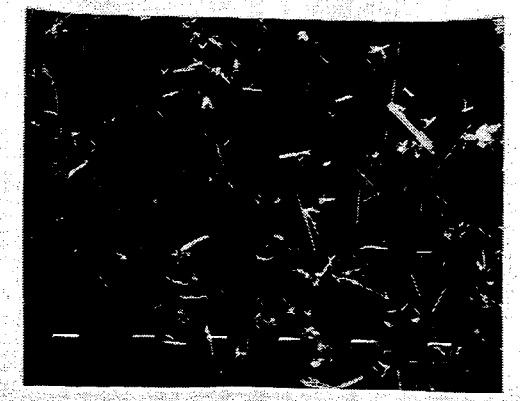
FIG. 4 shows an aluminum alloy matrix reinforced with silicon nitride whiskers.

A composite of aluminum alloy 5083 Al containing 8 Vf% whisker silicon nitride $Si_3N_4$ is prepared by repeating the process as shown in Example 1, except the reinforcing material is replaced with $Si_3N_4$ whiskers, 0.3–0.6 $\mu$m diameter with 5–15 $\mu$m length, aspect ratio 10-40; and the dispersing agent is 0.3% aqueous solution of sodium hexaphosphate. FIG. 4 shows an effective homogeneous reinforcement of silicon nitride in the aluminum alloy.

EXAMPLE 3

Figure 5:
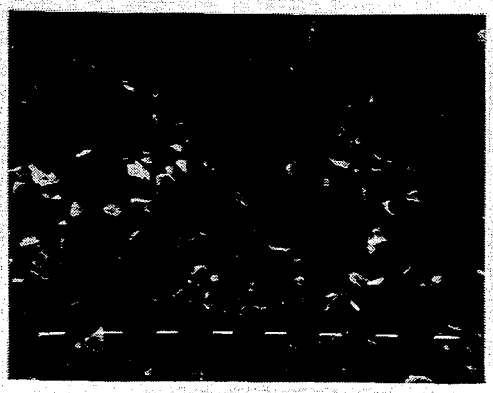
FIG. 5 shows an aluminum alloy matrix reinforced with silicon carbide particulates.

An aluminum alloy-matrix composite of 5083 Al reinforced with 8 Vf% silicon carbide (SiC) particulates is prepared by repeating the process of Example 1, except that the reinforcing material is replaced with 2.5–3.5 $\mu$m particulate SiC and the dispersing agent is an aqueous solution of 0.01 mol sodium pyrophosphate. FIG. 5 shows an effective homogeneous reinforcement of such SiC fibers into the matrix of aluminum alloy in accordance with the present invention.

Figure 6:
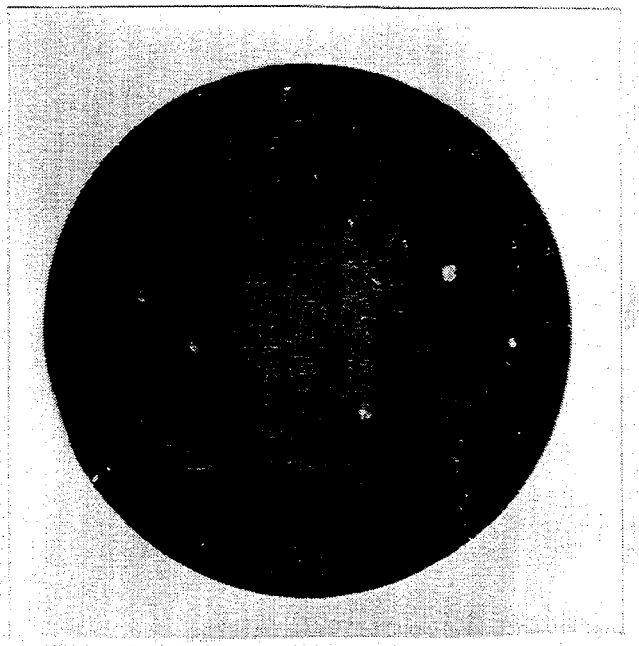
FIG. 6 is a sectional drawing of a composite of the present invention before being degassed.
Figure 7:
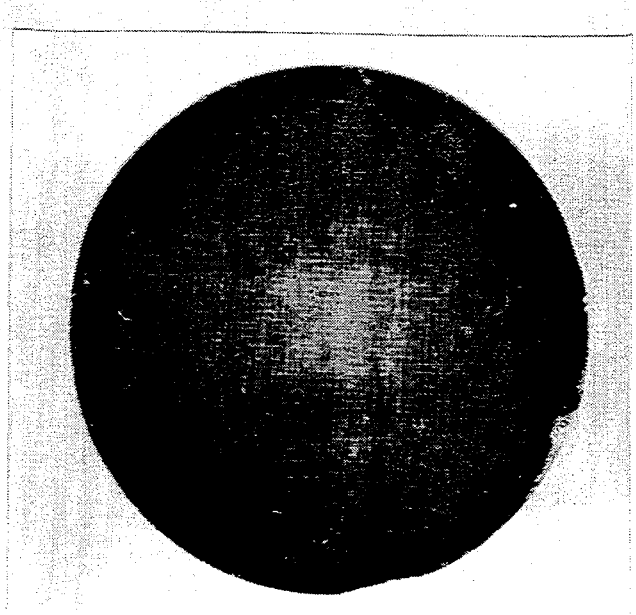
FIG. 7 shows a finished degassed composite in accordance with the present invention.

The casting ingot made in accordance with the present invention (as per Example 1) after being degassed is shown in FIG. 7, in which almost no porosity exists in the alloy in comparison with the porosity existing in the alloy as shown in FIG. 6 which is not degassed from a casting product as per Example 1 (without the degassing step).

From the aforementioned and the drawing figures accompanied herewith the present invention provides a process for making an aluminum alloy matrix homogeneously reinforced with ultrafine reinforcing material without porosity, to be susperior to any conventional process for making composite since the very fine reinforcing material (even as large as 1 μm) reinforced into the metal matrix by any conventional process may not result in a composite product of homogeneous dispersion without clustering and porosity as expected by this invention.

Besides the aluminum alloy as shown in the examples, other metal matrixes can be used in accordance with the method of the present invention for liquid casting of metal-matrix composites.

The ultrafine reinforcing materials added in the aluminum-alloy matrix can be selected from: alumina, silicon nitride and silicon carbide (as shown in Examples 1–3); and other ultrafine materials, such as: titanium carbide, zirconium oxide, boron carbide and tantalum carbide. The reinforcing materials can be added in the forms of: particles, short fibers, or whiskers.

The present invention provides a method for making metal-matrix composite with cheaper cost and simpler process. The ultrafine reinforcing material has been successfully incorporated into the metal matrix in a homogeneous form with minimized porosity, thereby improving the quality and properties of the metal-matrix composites.

The present invention may be modified without departing from the spirit and scope as claimed in this invention. The aforesaid examples and description are provided just for describing the process and the product of the present invention, not for limiting the present invention.

The particle size of the ultrafine reinforcing material of this invention may be made as fine as 0.05 μm, or even finer, which however is not limited in this invention.

I claim:

1. A process for making aluminum alloy-matrix composites comprising:

preparing a suspension liquid by suspending ultrafine reinforcing material in a distilled water containing a dispersing agent therein in a closed condition;

oscillating the suspension liquid by ultrasonic waves in the closed condition;

preheating the suspension liquid at a temperature from 100° C. to 660° C.;

melting an aluminum alloy matrix at a temperature from 660° C. to 700° C. and distributing the suspension liquid, which is pre-heated, onto a surface of a molten solution of the aluminum alloy matrix under continuously agitating for mixing said matrix and said reinforing material by a distributing method;

degassing a molten solution of an aluminum alloy-matrix composite formed by said aluminum alloy matrix reinforced with said ultrafine reinforcing material; and casting the molten solution of the aluminum alloy-matrix composite to form an ingot.

2. A process for making aluminum alloy-matrix composites according to claim 1, wherein said distributing method for distributing the suspension liquid onto a surface of said molten solution is a spraying operation.

3. A process for making aluminum alloy-matrix composites according to claim 1, said distributing method for distributing the suspension liquid onto a surface of said molten solution is an atomizing operation.

4. A process according to claim 1, wherein the melting of said matrix, the spraying of said reinforcing material, the mixing of said matrix and said reinforcing material, and the degassing, are all conducted under an inert gas atmosphere.

5. A process according to claim 1, wherein said ultrafine reinforcing material is selected from the group of: alumina, silicon nitride, silicon carbide, titanium carbide, zirconium oxide, boron carbide, and tantalum carbide; which is present in the forms selected from: a particle, a whisker, and a short fiber.

6. A process according to claim 1, wherein said ultrafine reinforcing material is selected from: alumina, silicon carbide, and silicon nitride.

* * * * *